US012606757B2

(12) United States Patent
Burns, Jr. et al.

(10) Patent No.: US 12,606,757 B2
(45) Date of Patent: Apr. 21, 2026

(54) ALCOHOL BASED UNLEADED AUTOMOTIVE RACING FUEL

(71) Applicants: Andrew Stephen Burns, Jr., Hamilton, MT (US); Paul Yaw, Mesa, AZ (US)

(72) Inventors: Andrew Stephen Burns, Jr., Hamilton, MT (US); Paul Yaw, Mesa, AZ (US)

(73) Assignee: TURN 3 HOLDINGS LLC, Amarillo, TX (US)

( * ) Notice: Subject to any disclaimer, the term of this patent is extended or adjusted under 35 U.S.C. 154(b) by 0 days.

(21) Appl. No.: 18/904,929

(22) Filed: Oct. 2, 2024

(65) Prior Publication Data

US 2026/0035631 A1 Feb. 5, 2026

Related U.S. Application Data

(60) Provisional application No. 63/587,392, filed on Oct. 2, 2023.

(51) Int. Cl.

| | |
|---|---|
| ***C10L 1/02*** | (2006.01) |
| ***C10L 1/16*** | (2006.01) |
| ***C10L 1/19*** | (2006.01) |

(52) U.S. Cl.

CPC ..... *C10L 1/023* (2013.01); *C10L 1/1608* (2013.01); *C10L 1/19* (2013.01); *C10L 2270/023* (2013.01)

(58) Field of Classification Search

CPC ..... C10L 1/023; C10L 1/1608; C10L 1/19; C10L 2270/023

See application file for complete search history.

(56) References Cited

U.S. PATENT DOCUMENTS

| | | | |
|---|---|---|---|
| 4,081,252 | A | 3/1978 | Osborg |
| 4,333,739 | A | 6/1982 | Neves |
| 4,376,433 | A | 3/1983 | Spakowski |
| 4,384,872 | A | 5/1983 | Kester et al. |
| 4,410,333 | A | 10/1983 | Fujimoto |
| 4,448,586 | A | 5/1984 | Wiedig |
| 4,561,861 | A | 12/1985 | Davis et al. |

(Continued)

FOREIGN PATENT DOCUMENTS

| | | | |
|---|---|---|---|
| CN | 101328436 | A | 12/2008 |
| CN | 104017614 | A | 9/2014 |

(Continued)

OTHER PUBLICATIONS

Jan. 2, 1986—EP0166096A1—Motor Fuels. Muller Heinrich. Espacenet English Machine translation—Bib Data, Description and Claims.

(Continued)

*Primary Examiner* — Latosha Hines

(74) *Attorney, Agent, or Firm* — R. Reams Goodloe, Jr.

(57) ABSTRACT

Alcohol based unleaded automotive racing fuels, using blends of four basic chemical components, including ethanol, methanol, toluene, and isopentane and/or cyclopentane. Mixtures provide increased power, and better charge cooling than conventional racing gasolines, whether leaded or unleaded. The claimed racing fuel blends do not include gasoline, isooctane, or alkylate fractions common to alcohol-gasoline mixtures such as E85 alcohol based fuels. The novel fuel blends claimed can be manufactured from commonly available pure chemical components, and make possible distributed manufacture of automotive racing fuels.

15 Claims, 4 Drawing Sheets

(56) References Cited

U.S. PATENT DOCUMENTS

| | | | | |
|---|---|---|---|---|
| 4,565,548 | A | 1/1986 | Davis et al. | |
| 4,610,696 | A | 9/1986 | Bernasconi et al. | |
| 4,743,272 | A | 5/1988 | Weinberger | |
| 4,801,305 | A * | 1/1989 | Muller | C10L 1/023 44/451 |
| 5,159,898 | A | 11/1992 | Hartel et al. | |
| 5,179,926 | A | 1/1993 | Ament | |
| 5,470,358 | A * | 11/1995 | Gaughan | C10L 1/223 44/426 |
| 5,688,295 | A * | 11/1997 | Yang | C10L 1/026 44/438 |
| 5,697,987 | A * | 12/1997 | Paul | C10L 1/023 44/352 |
| 5,881,559 | A | 3/1999 | Kawamura | |
| 10,619,580 | B2 | 4/2020 | Bromberg et al. | |
| 10,899,988 | B1 * | 1/2021 | Davis | C10L 1/02 |
| 2001/0034966 | A1 | 11/2001 | Golubkov et al. | |
| 2002/0026745 | A1 * | 3/2002 | Nakahama | C10L 1/023 44/451 |
| 2002/0045785 | A1 * | 4/2002 | Bazzani | C10L 1/06 585/14 |
| 2003/0046862 | A1 | 3/2003 | Wolf et al. | |
| 2003/0154649 | A1 | 8/2003 | Hull et al. | |
| 2003/0183554 | A1 * | 10/2003 | Bazzani | C10L 1/06 585/14 |
| 2008/0110080 | A1 | 5/2008 | Ansell et al. | |
| 2008/0295574 | A1 | 12/2008 | Miersch-Wiemers et al. | |
| 2009/0193711 | A1 | 8/2009 | Clark et al. | |
| 2010/0005709 | A1 | 1/2010 | Bradin | |
| 2010/0326410 | A1 | 12/2010 | Yeh et al. | |
| 2011/0067674 | A1 | 3/2011 | Kasseris et al. | |
| 2013/0227878 | A1 * | 9/2013 | Wolf | C10L 1/2387 44/434 |
| 2013/0255141 | A1 | 10/2013 | Ried | |
| 2022/0389340 | A1 | 12/2022 | Serve et al. | |
| 2024/0409832 | A1 | 12/2024 | Rogers et al. | |

FOREIGN PATENT DOCUMENTS

| | | | | |
|---|---|---|---|---|
| CN | 115232654 | A | 10/2022 | |
| EP | 0166096 | A1 | 1/1986 | |
| JP | S6429665 | A | 1/1989 | |
| JP | 2017053234 | A | 3/2017 | |
| WO | WO-2009002056 | A1 * | 12/2008 | C10L 1/023 |

OTHER PUBLICATIONS

Jan. 31, 1989—JP S6429665A—Fuel Feed Device for Alcohol Fuel Engine. Yamagata Ichiro. Japanese Patent Office English translation Abstract, Description and Claims.

Dec. 24, 2008—CN101328436A—Alcohol Fuel and Preparation Thereof. Bingyu Yu. Espacenet English Machine translation Bib Data, Description and Claims.

Sep. 3, 2014—CN104017614A—High-Performance Alcohol-Based Fuel. Li Guangdong. Espacenet English Machine translation Bib Data, Description and Claims.

Mar. 16, 2017—JP2017053234A—Fuel Supply System for Engine. Okumi Masayoshi. Espacenet English Machine translation—Bib Data, Description and Claims.

Oct. 25, 2022—CN115232654A—Alcohol-Based Either Liquid Fuel and Preparation Method Thereof. Luke. Espacenet English Machine translation Bib Data, Description and Claims.

Petro Industry News—Annual Buyers Guide 2017, Characterizing Fuel by Gas Chromatography: Making sure That Indycar Race Teams Are Playing by the Rules. www.petro-online.com.

Ethanol Fuel—Wikipedia—printed Sep. 26, 2023.

EIA Energy Information Administration. MTBE, Oxygenates, and Motor Gasoline. Modified: Mar. 6, 2000. www.eia.doe.gov.

MTBE in Fuels—2013 status update. https://archive.epa.gov/mtbe/web/html/faq.html.

* cited by examiner

ALCOHOL BASED UNLEADED AUTOMOTIVE RACING FUEL

REFERENCE TO RELATED PATENT APPLICATIONS

This application claims priority from prior U.S. Provisional Patent Application Ser. No. 63/587,392 filed Oct. 2, 2023, entitled AUTOMOTIVE RACING FUEL, the disclosure of which is incorporated herein in its entirety, including the specification and claims, by this reference.

STATEMENT OF GOVERNMENT INTEREST

Not Applicable.

TECHNICAL FIELD

This disclosure relates to fuels for high performance spark ignition piston automotive racing engines, for example as used in auto or motorcycle racing events, and more particularly, to alcohol based unleaded racing fuel blends.

BACKGROUND

Various fuel formulations are now utilized in the automotive and motorcycle racing world. Many existing fuel formulations are leaded hydrocarbon fuels, as allowed in the United States under an exemption provided by the 1990 Federal Clean Air Act Amendments. Since that Act banned the use of leaded fuels for over-the-road vehicles in the United States, attention is increasingly directed at fuels utilized in motor sports on closed tracks, with the suggestion that investigation into the development and evaluation of unleaded alternatives for high performance racing fuels be undertaken.

The largest component of most existing over-the-road unleaded fuels, and in leaded hydrocarbon based racing fuels, is light alkylate. Light alkylate is typically a refinery product from an acid alkylation unit which combines branched butane with straight-chained hydrogen unsaturated butane in the presence of an acid catalyst. Lighter alkylates typically boost octane, which allows a fuel manufacturer to meet various reformulated gasoline specifications. However, depending on raw materials, their source, and operation of the alkylation unit, the specific mix of final ingredients, i.e. the amounts and types of various alkylates, may vary significantly.

Thus, in spite of the testing and evaluation of various candidate unleaded racing fuels, and as a consequence of the above identified problems, there still remains an as yet unmet need for a simply formulated, low cost, and easily tested automotive racing fuel blend that can be readily used in the existing spark ignited internal combustion automotive racing piston engines, with minimal "set-up" requirements. Such a fuel, particularly a fuel that can be simply and easily tested as to composition, would be of significant benefit to automotive racing teams and to race administrative organizations. And, at current costs for various chemical ingredients for fuels, it is anticipated that such a novel fuel would significantly reduce costs to race teams for their fuel requirements over the course of a racing season. This cost reduction is especially enhanced due to avoidance of exotic blending components that might be otherwise necessary or desirable in providing a competitive automotive racing fuel. Importantly, a racing fuel having simple build characteristics should enable widely distributed racing fuel manufacturing-using remote blending operations-yet avoid the variability of regional or seasonal alkylate blend compositions. And, such a simply formulated fuel should enable quick, simple, and inexpensive testing to assure compliance with a particular fuel specification, according to parameters and fuel compositions specified.

Significantly, by avoiding the need for extensive redesign of racing engines or their set-up requirements, an alcohol based, low cost unleaded racing fuel blend as described herein should become easily adoptable by the automotive racing community. And, it would be of significant advantage if such a fuel provides desirable performance characteristics, which would thus enable adoption and widespread use.

SOME OBJECTS, ADVANTAGES, AND NOVEL FEATURES

Accordingly, one objective of our invention is to provide an unleaded automotive racing fuel blend composition which can be easily blended, without the need of obtaining specialized hydrocarbon compositions, such as alkylate or other products normally available only in refinery internal process streams, or purchasing more exotic blending components that might be otherwise necessary or desirable in providing a competitive automotive racing fuel.

Another related objective of our invention is to provide an unleaded automotive racing fuel blend composition that can be blended in small batches at remote, small facilities, without the need of large storage tanks, or resulting large scale transport and delivery equipment.

An advantage of the simple, low cost unleaded automotive racing fuel blend as described herein is that it is amenable to manufacturing on a distributed basis, since a simple list of pure chemical components can be procured and blended by many specialty fuel suppliers. Thus, dependence on a few refiners or large scale racing fuel suppliers may be substantially or entirely eliminated, which is a benefit that should also reduce both fuel costs, as well as transport costs of our unleaded automotive racing fuel blend to racing venues.

In an embodiment, it is an advantage that use of only a few well defined, commercially pure fuel grade chemical compounds as constituents provides a novel, low cost alcohol based racing fuel blend which is anticipated to significantly reduce the cost and time required for fuel testing, and thus, increase fuel testing occurrence, and assure substantial improvement in compliance of racers with racing fuel specifications.

Thus, it is an advantage of the unleaded automotive racing fuel blend described herein that fuel composition testing procedures are simplified, and thus enforcement of compliance with fuel standards at racing venues is simplified. It is an advantage of the fuel blends described and claimed herein that fuel quality checks by fuel blenders, racing teams, and racing governing bodies can be simplified by simple, low cost gas chromatograph testing of fuel samples.

Another important objective is to provide an unleaded automotive racing fuel which provides increased power, compared to a conventional oxygenated hydrocarbon based unleaded racing fuel.

An important advantage of the unleaded automotive racing fuel blend described herein is that the specified fuel blend composition provides a higher flame speed than conventional oxygenated hydrocarbon based unleaded racing fuels, a property which provides (a) resistance to residual content, which in turn allows leaner mixtures, increasing economy, especially at part throttle, (b) increased power output, especially at high rpm, since a greater portion of the combustion event can be concentrated after top dead center (TDC) where it is effectively converted to useful work; and (c) increased knock resistance, since the end gasses have less time to absorb heat from the advancing flame front.

Another advantage of the unleaded automotive racing fuel blend described herein is that that the broad range of flammability of the fuel blend improves throttle response during transient events when mixture quality is less than ideal, which results in more controllable application of power, enabling a race car driver to more smoothly transition from the mid-corner phase to the acceleration phase of the corner.

Further, it is an advantage that a new low cost unleaded automotive racing fuel can be utilized with existing carburetor or fuel injection designs, with modifications applicable with respect to required air-fuel ratios for multi-alcohol fuel blends, so as to take full advantage of existing mechanical design components and materials of construction utilized in currently available fuel systems.

It is yet another advantage that the novel, alcohol based unleaded automotive racing fuel described herein provides a significant charge cooling effect to an engine utilizing the fuel, due to the relatively large latent heat of vaporization of the methanol and ethanol components, as compared to conventional hydrocarbon based racing fuels. In short, use of the novel fuel blend described herein removes a greater amount of heat from the intake charge than hydrocarbon based fuels due to the increased latent heat of vaporization of alcohols, as well as due to the higher mass flow requirements of alcohols.

Thus it is an advantage that the novel unleaded automotive racing fuel described herein can be utilized with minimal set-up adjustments, to ultimately provide high performance engine operation without adverse knock or detonation, with existing compression ratios and at full rated power output, in a stable and highly efficient manner in normal race car operating conditions.

In summary, it is an advantage that the new unleaded automotive racing fuel as described herein may be produced and distributed as an easily adoptable substitute for existing automotive racing fuels, whether leaded racing fuels based on petroleum feedstock (e.g. alkylate based fuels), or currently available unleaded racing fuels such as E85 blends which use about eighty five percent (85%) ethanol, and fifteen percent (15%) hydrocarbon components, which may include selected denaturants added to the ethanol, and various other gasoline mixes or other hydrocarbons.

SUMMARY

Alcohol based unleaded automotive racing fuel blends have been developed which avoid the use of either mostly ethanol, or mostly methanol, or of alcohol/gasoline blends. In other words, novel alcohol based unleaded automotive racing fuel blends have been developed that avoid the use of primarily or solely methanol, or primarily or solely ethanol, or of various hydrocarbons (other than toluene and isopentane) such as higher molecular weight alkylates streams of varying composition, or rather expensive isooctane, or most other typical hydrocarbon constituents as may be found in various conventional automotive gasoline formulations.

A novel alcohol based unleaded automotive racing fuel blend has been developed, which in an embodiment may include, as blend constituents, (a) methanol at about thirty five percent (35%) by volume, (b) ethanol at about thirty five percent (35%) by volume, (c) toluene at about twenty two percent (22%) by volume, (d) isopentane or cyclopentane, or mixtures thereof, at about eight percent (8%) by volume, and (e) optionally, one or more additives selected from the group consisting of anti-oxidants, anti-static additives, corrosion inhibitors, denaturants, co-solvents, lubricants, and mixtures thereof. In an embodiment, a novel unleaded automotive racing fuel blend may consist essentially of the constituents just mentioned above. And, in an embodiment, a novel automotive racing fuel blend may consist entirely of the constituents just mentioned above. In various embodiments, one or more of the optional constituents mentioned may be included. And, in various embodiments, one or more of the optional constituents may be omitted.

In other embodiments, a novel alcohol based unleaded automotive racing fuel may include, as blend constituents, (a) methanol at from thirty percent (30%) to forty percent (40%) by volume, (b) ethanol at from forty percent (40%) to thirty percent (30%) by volume, (c) toluene at from thirty five percent (35%) to nineteen percent (19%) by volume, (d) isopentane or cyclopentane, or mixtures thereof, at from three percent (3%) to fifteen percent (15%) by volume, and (e) optionally, one or more additives selected from the group consisting of anti-oxidants, anti-static additives, corrosion inhibitors, denaturants, co-solvents, lubricants, and mixtures thereof. In an embodiment, a novel unleaded automotive racing fuel blend may consist essentially of the constituents just mentioned above. And, in an embodiment, a novel unleaded automotive racing fuel blend may consist entirely of the constituents just mentioned above. In various embodiments, one or more of the optional constituents mentioned may be included. And, in various embodiments, one or more of the optional constituents may be omitted.

In various embodiments, an alcohol based unleaded automotive racing fuel blend has been developed which avoids the use of the higher molecular weight alkylates or isooctane as may be found in various conventional unleaded automotive racing gasoline formulations, and which provide the advantage of effective charge cooling, the effect of which is magnified by the significantly increased mass flow rate of the fuel compared to gasoline based fuels, while simultaneously providing additional power output over currently available unleaded racing gasolines.

BRIEF DESCRIPTION OF THE DRAWING

The present invention(s) will be described by way of exemplary embodiments, using for illustration the accompanying drawing, and in which.

Figure 1:
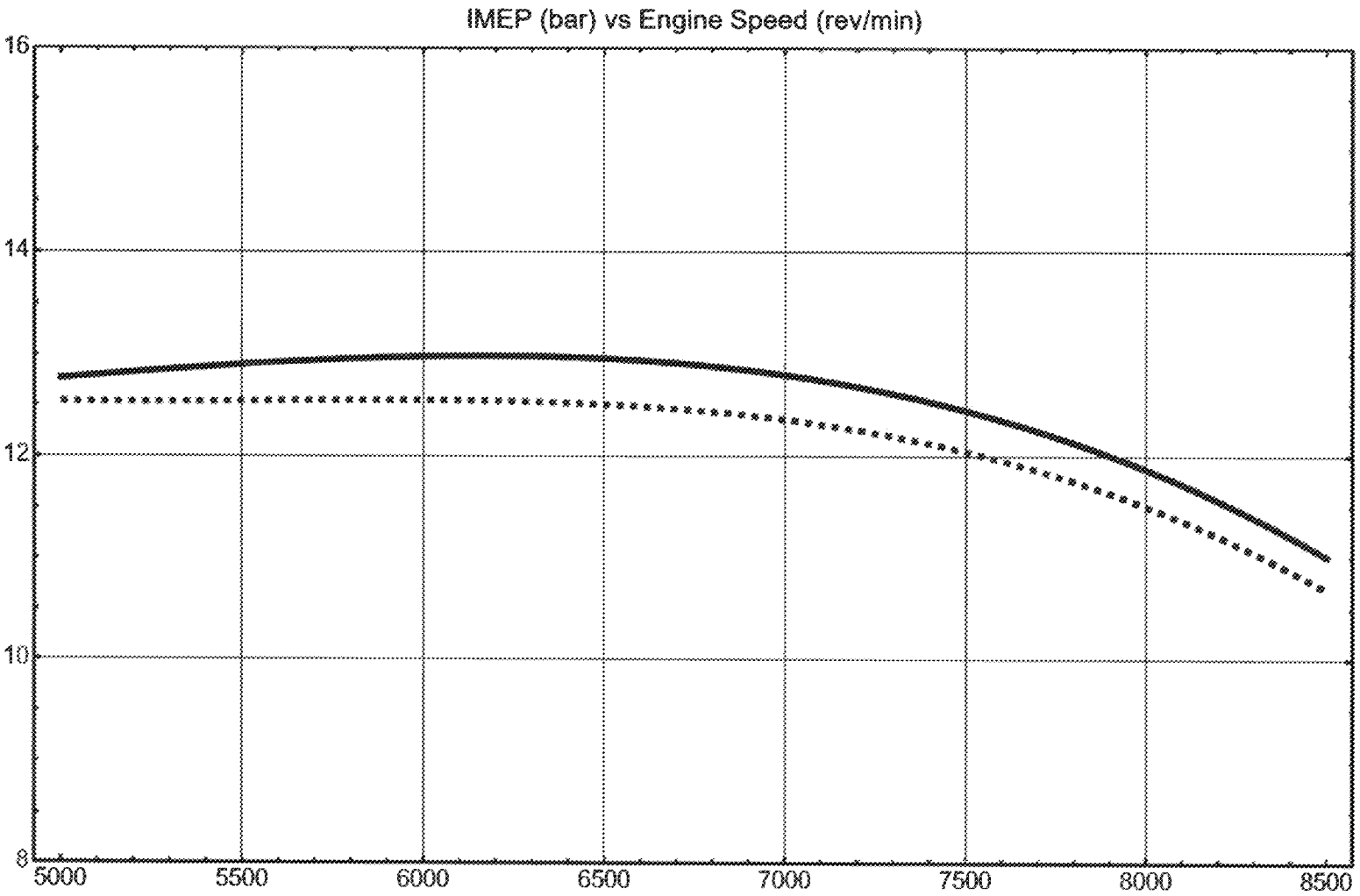
FIG. 1 is a graph showing test results of an embodiment of the unleaded automotive racing fuel blend described herein, showing the indicated mean effective pressure (IMEP, in bar) at a range of engine speeds (in RPM), as compared to the indicated mean effective pressure (IMEP) produced by a conventional Sunoco® unleaded automotive racing gasoline (Sunoco® 260 GT Plus).

The foregoing figures, being merely exemplary, contain various data that is suggestive of the improvement to the automotive racing community that is made available by use of the alcohol based unleaded automotive racing fuel described herein. While the degree of improvement available over fuels currently in use may vary based on the precise composition of conventional unleaded automotive racing fuels (e.g. variance in composition of so called E85 fuels), the findings set out in the drawing figures herein indicate that a notable performance edge is available to automotive racing teams that adopt use of the novel alcohol based unleaded automotive racing fuel described and claimed herein.

DESCRIPTION

Efforts were undertaken to explore the feasibility of defining composition parameters for an alcohol based unleaded automotive racing fuel having, as principal constituents, commonly available chemicals that are presently obtainable by commercial purchasers in commercially pure condition. One result of such efforts has been the discovery that a specific, relatively narrow range of blends of ethanol, methanol, toluene, and isopentane (also known as 2-methylbutane), or cyclopentane, or mixtures of isopentane and cyclopentane, provides a notable improvement in engine power output, compared to a conventional (E85 based, i.e. fifteen percent (15%) gasoline or other hydrocarbons, and eighty five percent (85%) ethanol).

In an experimental setup, a high performance Honda® two (2)-cylinder engine, having a one thousand (1000) cc (cubic-centimeters) displacement, four (4) valves per cylinder four (4) stroke engine having a ten to one (10:1) compression ratio was used for conducting experiments to evaluate the novel alcohol based unleaded automotive racing fuel described and claimed herein against a Sunoco® unleaded racing fuel. Tests were performed at wide open throttle (WOT) from five thousand (5000) to eight thousand five hundred (8500) RPM (revolutions per minute). Cylinder pressure was recorded with a mobile test system comprised of two (2) AVL® Indimicro Model 602's, an AVL Vehicle Interface Model 303, and AVL Model GH15D combustion pressure sensors (all available from AVL List GmbH, Hans-List-Platz 1, A-8020 Graz, Austria). Airbox pressure, temperature and specific humidity were also monitored and processed for atmospheric compensation.

Figure 2:
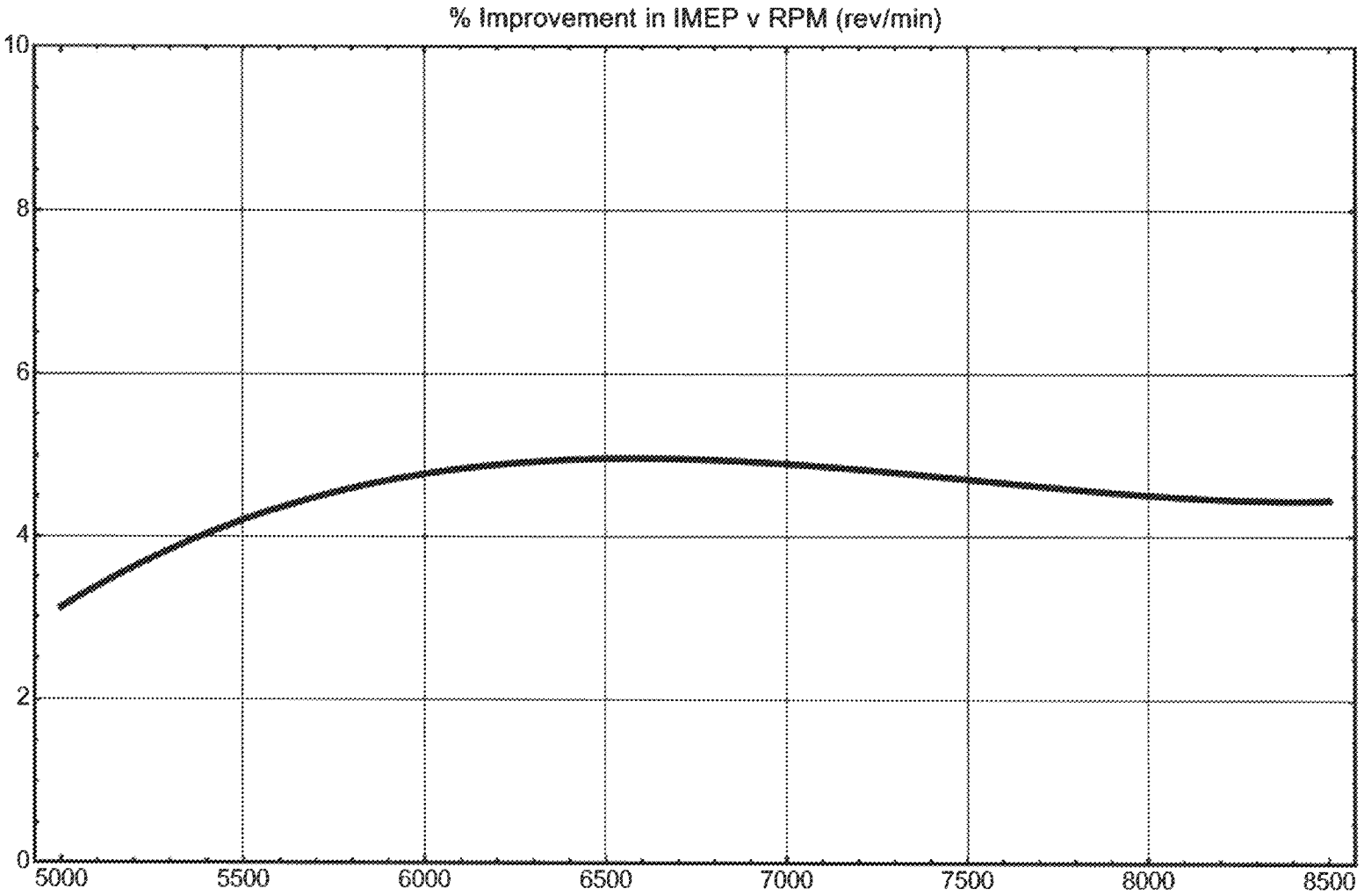
FIG. 2 is a graph showing the percent improvement in indicated mean effective pressure of the automotive racing fuel described herein, showing the percent improvement in indicated mean effective pressure (IMEP, in bar) at a range of engine speeds (in RPM), over the indicated mean effective pressure (IMEP) produced by a conventional Sunoco® unleaded automotive racing gasoline (Sunoco 260 GT Plus).

Initial results of testing are shown in FIG. 1. Compared to a conventional Sunoco unleaded racing gasoline (Sunoco® 260 GT Plus), a test fuel blend composition of thirty five percent (35%) ethanol, thirty five percent (35%) methanol, twenty two percent (22%) percent toluene, and eight percent (8%) isopentane was found to have an average of four point five percent (4.5%) greater indicated mean effective pressure (IMEP) across the tested range of engine speeds as noted above. More precisely, FIG. 2 shows the measured improvement of indicated mean effective pressure (IMEP) of the fuel blend claimed herein in terms of the percentage improvement, at the tested range of engine speeds.

As an Example 1, a useful cost effective alcohol based unleaded automotive racing fuel blend (see TABLE 1 below) may include (a) from about thirty percent (30%) to about forty percent (40%) of methanol by volume, (b) from about forty percent (40%) to about thirty percent (30%) of ethanol by volume, (c) from about fifteen percent (15%) to about twenty five percent (25%) toluene by volume, and (d) from about three percent (3%) to about fifteen percent (15%) isopentane by volume.

As an Example 2, and within the parameters of Example 1 above, in yet another useful embodiment, a low cost alcohol based unleaded automotive racing fuel blend may include equal amounts of methanol and ethanol, by volume.

As an Example 3, and within the parameters of Example 1 above, in yet another embodiment, the amounts of methanol and ethanol may each be present in equal amounts of about forty percent (40%) or less, by volume.

As an Example 4, and within the parameters of Example 1 above, in yet another embodiment the amounts of methanol and ethanol may be present in unequal amounts.

As an Example 5, in yet another embodiment formulated as set out in Example 4, the amount of methanol may be larger than the amount of ethanol, by volume.

As an Example 6, in another embodiment formulated as set out in Example 4, the amount of methanol may be up to as much as ten percent (10%) larger than the amount of ethanol, by volume.

As an Example 7, in another embodiment formulated as set out in Example 4, the amount of ethanol may be larger than the amount of methanol, by volume.

As an Example 8, in another embodiment formulated as set out in Example 4, the amount of ethanol may be up to as much as ten percent (10%) larger than the amount of methanol, by volume.

As an Example 9, in another embodiment, the amount of toluene may be up to as much as thirty five percent (35%), by volume.

In the various examples just mentioned, above, and elsewhere herein, where not otherwise already specified, the amount of isopentane may be adjusted where necessary or required for assuring adequate Reid Vapor Pressure (RVP) of a final low cost alcohol based unleaded automotive racing fuel blend to meet applicable racing conditions, such as the ambient temperature anticipated on race day. As noted elsewhere herein, the amount of isopentane specified may be provided by isopentane, or by cyclopentane, or by mixtures thereof. In any one of the embodiments set forth, when making such adjustment to the amount of isopentane present, the amounts of other constituents may be selected for further addition or deletion, to complete a workable, high performance, low cost alcohol based unleaded automotive racing fuel blend.

Table 1 sets out constituent compositions for exemplary four component alcohol based unleaded automotive racing FUEL BLENDS U-1, U-2, U-3, U-4, U-5, U-6, U-7, U-8, and U-9. It is to be understood that amounts of various blend constituents may be utilized between the upper and lower limits of various constituents, inclusive, within the ranges noted, and remain within the broad range of constituents where noted herein, and as similarly specified within the scope of the accompanying claims.

TABLE 1

| Four Component Alcohol Based Unleaded Automotive Racing Fuel Blends | | | | |
|---|---|---|---|---|
| Blend # | Methanol | Ethanol | Toluene | Isopentane |
| U-1 | 35 | 35 | 22 | 8 |
| U-2 | 35 | 35 | 19 | 11 |
| U-3 | 35 | 35 | 15 | 15 |
| U-4 | 36 | 36 | 25 | 3 |
| U-5 | 30 | 40 | 25 | 5 |
| U-6 | 30 | 40 | 22 | 8 |
| U-7 | 40 | 30 | 25 | 5 |
| U-8 | 40 | 30 | 22 | 8 |
| U-9 | 30 | 30 | 35 | 5 |

Notes with regard to TABLE 1. Fuel blend composition is reported as percent by volume. Cyclopentane, or blends of isopentane and cyclopentane, may be substituted for isopentane alone, in any of the fuel blends set out in TABLE 1 above, or generally as described herein, unless otherwise expressly excluded by context. Additionally, in any of the fuel blends described herein, optionally, one or more additives may additionally be included; such additives may include antioxidants, anti-icing agents, anti-static additives, corrosion inhibitors, dyes, denaturants, co-solvents, lubricants, and mixtures thereof. Further, in an embodiment, a novel automotive racing fuel blend may consist essentially of the constituents set forth in Table 1. And, in an embodiment, a novel unleaded automotive racing fuel blend may consist entirely of the constituents set forth in Table 1, above, including any one or more of the optional constituents mentioned. And, in various embodiments, one or more (or all) of the optional constituents may be omitted. Finally, it is to be understood that amounts of various blend constituents may be utilized in a range between the upper and lower limits, inclusive, of the specific component compositions as noted in Table 1, and remain within the broad range of constituents where noted herein and as specified within the scope of the accompanying claims.

Figure 3:
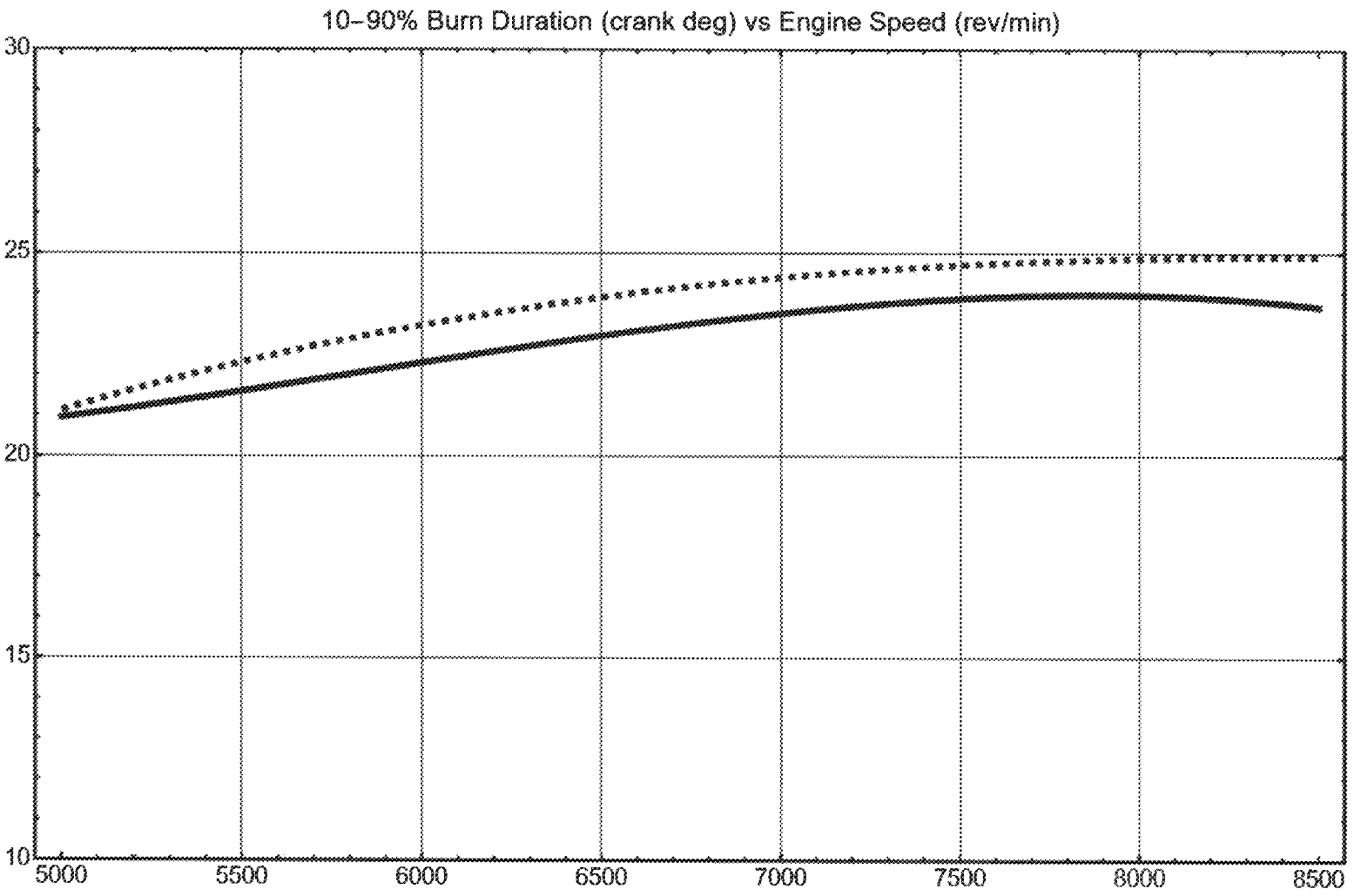
FIG. 3 is a graph showing test results of an embodiment of the unleaded automotive racing fuel blend described herein, showing the ten to ninety percent (10%-90%) burn duration, by crank degrees, of the unleaded automotive racing fuel described herein, as compared to the ten to ninety percent (10%-90%) burn duration provided by a conventional Sunoco® unleaded automotive racing gasoline (Sunoco 260 GT Plus).

Returning now to additional test results, FIG. 3 shows test results of tests conducted on an embodiment of the unleaded automotive racing fuel described herein, having the same composition as that set out in test described in paragraph [0032], showing the ten to ninety percent (10%-90%) burn duration, by crank degrees, of the unleaded automotive racing fuel described herein, as compared to the ten to ninety percent (10%-90%) burn duration provided by a conventional Sunoco® unleaded automotive racing gasoline.

Figure 4:
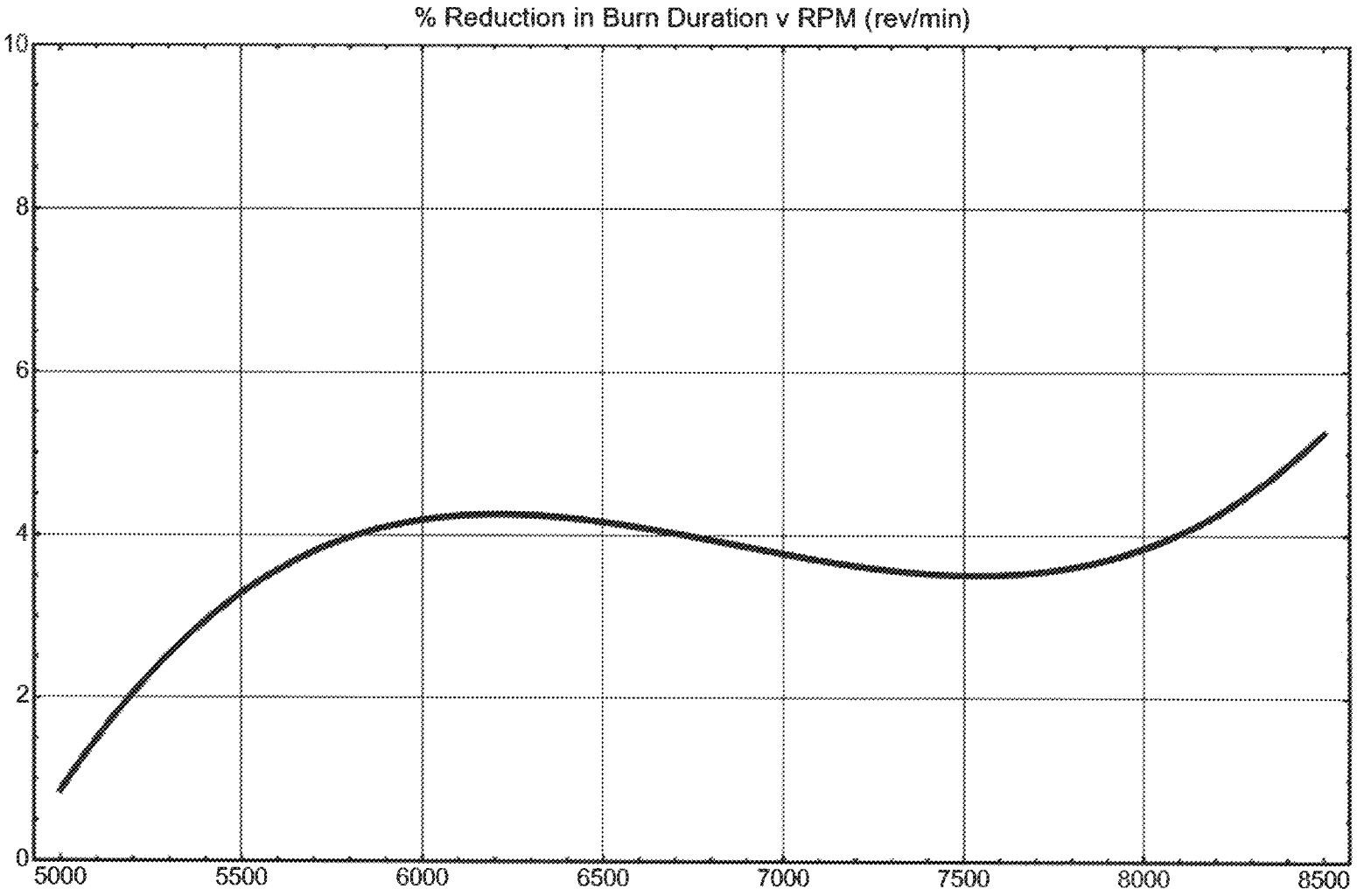
FIG. 4 is a graph showing test results of an embodiment of the unleaded automotive racing fuel blend described herein, showing the percent improvement in the ten to ninety percent (10%-90%) burn duration, by crank degrees, of the unleaded automotive racing fuel described herein, over the ten to ninety percent (10%-90%) burn duration provided by a conventional Sunoco® unleaded automotive racing gasoline (Sunoco 260 GT Plus).

FIG. 4 is a graph showing test results of an embodiment of the unleaded automotive racing fuel described herein, showing the percent improvement in the ten to ninety percent (10%-90%) burn duration, by crank degrees, of the unleaded automotive racing fuel described herein, over the ten to ninety percent (10%-90%) burn duration provided by a conventional Sunoco® unleaded automotive racing gasoline.

As shown in FIG. 4, compared to a conventional Sunoco unleaded racing gasoline (e.g. Sunoco® 260 GT Plus), the novel alcohol based unleaded racing fuel blend tested provides an average of four percent (4%) reduction in burn duration. Burn duration, as measured, is the time taken from ten percent (10%) to ninety percent (90%) combustion of the fuel, and is commonly depicted in terms of crank angle, or CA, that is required to complete combustion between those limits. As shown in FIG. 3, at 8400 RPM, the crank angle CA required for ten percent (10%) to ninety percent (90%) combustion of the Sunoco unleaded gasoline base fuel was about 25° C. A. The novel alcohol based unleaded automotive racing fuel blend tested required a combustion duration crank angle of about 23.7° C. A. The actual percentage reduction in burn duration varies as the RPM is increased, with better reduction in burn duration at the higher RPMs. In general, shorter combustion duration of the novel fuel described herein works to improve engine performance—i.e. the fuel charged to the cylinder is burned in a shorter amount of time.

The novel alcohol based unleaded automotive racing fuel described herein, using a mixture of methanol and ethanol with isopentane, provides a broader range of flammability over conventional unleaded automotive racing fuels, such as Sunoco® 260 GT Plus. This property is beneficial because an air-fuel mixture in the cylinder of a liquid fueled engine is not homogenous. As a result, the air-fuel mixture in the vicinity of the flame kernel is rarely optimal, and thus, cycle to cycle variation occurs in the combustion process. Consequently, a broader range of flammability improves response during transient events during which mixture preparation is poor, and thus helps reduce the cycle to cycle variation, which also helps improve economy, engine smoothness, and power.

The novel alcohol based unleaded automotive racing fuel tested also provides a significant charge cooling effect to an engine utilizing the fuel, due to the relatively large latent heat of vaporization of the methanol and ethanol components, as compared to conventional hydrocarbon based racing fuels. In short, use of the novel fuel blend described herein removes heat through vaporization of the fuel, and because alcohol fuel flow rates to the engine are much larger than when using hydrocarbon based fuels, the charge cooling effect is beneficial due to both of these parameters, namely the latent heat of vaporization of the novel fuel blend, and the mass flow rate of the novel fuel blend, as compared to existing gasoline based fuels.

With respect to the beneficial charge cooling effect provided by the novel unleaded automotive racing gasoline described herein, this benefit may be more clearly understood using a concept called Total Heat, which is a normalized value directly proportional to the heat energy required to vaporize a stoichiometric mixture per unit mass of air. Conventional racing gasolines have Total Heat values in the range of twenty (20) to twenty five (25). Pure ethanol has a Total Heat value of eighty four (84). Methanol has a Total Heat value of one hundred forty seven (147). The fuel mixture tested as noted above has a Total Heat value of eighty eight (88), slightly better than neat ethanol. More specifically, the cooling effect as provided by the novel alcohol based unleaded automotive racing fuel blend described and claimed herein is some three and a half to four (3.5 to 4) times better than conventional racing fuel, when viewed using the Total Heat concept. In absolute terms, at fifty degrees centigrade (50° C.) inlet temperature, the maximum potential charge cooling effect of a stoichiometric mixture of a conventional unleaded race gasoline is approximately twenty degrees centigrade (20° C.), while an alcohol based unleaded racing fuel blend described herein and in particular as noted above as tested, and which has been designated as GEN5™ brand racing fuel, has a maximum potential charge cooling of eighty one degrees centigrade (81° C.). Depending upon the precise composition of a fuel blend within the range of compositions described herein, a GEN5™ brand racing fuel may provide maximum charge cooling in the range of from seventy eight degrees centigrade (78° C.) to eighty three degrees centigrade (83° C.). Consequently, the charge cooling provided by the novel alcohol based unleaded automotive racing fuel described herein is particularly advantageous when used in an automotive racing engine.

Overall, it is believed that one specific advantageous alcohol based automotive racing fuel blend will include (a) about thirty five percent (35%) methanol, (b) about thirty five percent (35%) ethanol, (c) about twenty two percent (22%) by weight of toluene, and (d) about eight percent (8%) isopentane, or cyclopentane, or mixtures thereof. Such a formulation may be expected to provide improved power and improved detonation performance in a racing fuel blend, and with improved charge cooling effect, as compared to currently available hydrocarbon based racing fuels when operated in spark ignited internal combustion piston engines.

In various embodiments, the alcohol based racing fuels described herein will be of interest to a large number of users of high performance spark ignited internal combustion piston engines, since such fuels will provide an easily blended, and easily tested unleaded fuel blend having a functional performance as good or better than traditional hydrocarbon based gasoline fuels.

In an embodiment, it may be useful, and of economic importance to certain segments of fuel users, to provide an alcohol based unleaded fuel blend that makes available low cost testing of batch samples, to assure conformity of a fuel sample with applicable specifications at or for a particular racing venue.

Further, various embodiments are feasible, as set forth above with respect to various percentages of blend components, and with respect to the specific formulation that have been tested. And, as noted above, where necessary or required for assuring adequate Reid Vapor Pressure (RVP) of a final simple formulation for unleaded automotive racing fuel, ratios of blend components may be varied, especially the amount of isopentane, or cyclopentane, or mixtures thereof.

In various embodiments, the fuels described herein may be distinguished from prior art fuels provided by blending one or more alcohols with an automotive gasoline by virtue of the fact that the fuel blend contains less than one percent (1%) hydrocarbon constituents other than those specified in a particular fuel blend. For example, in a method of use of an unleaded automotive racing fuel blend in a spark ignited internal combustion piston engine, such a fuel blend may be provided which consists essentially of methanol, ethanol, toluene, isopentane or cyclopentane, or mixtures thereof, and optionally, one or more additives selected from the group consisting of anti-oxidants, anti-icing agents, anti-static additives, corrosion inhibitors, dyes, denaturants, co-solvents, lubricants, and mixtures thereof; with the proviso that the fuel blend contains less than one percent (1%) of hydrocarbon constituents other than those just mentioned. This objective for minimizing extraneous hydrocarbon constituents may be more easily attained, and formulation control may be optimized, in those instances when ethanol can be obtained with denaturant in the form of isopentane, or tolulene, or mixtures thereof, as such ingredients are already components of the fuel blend described and claimed herein. In such a method, the unleaded automotive racing fuel blend is combusted in the spark ignited internal combustion piston engine, to provide motive force to a race car. Such a method of use of the method of use of the unleaded automotive racing fuel blend provides one or more benefits, including performance predictability based on a selected fuel blend, reduced fuel blend testing costs, reduced fuel testing turnaround time, distributed fuel blending capability, reduced fuel blend cost.

In the various fuel blends discussed herein, the methanol composition is preferably fuel grade, i.e. at least ninety eight percent (98%) methanol. Preferably, the methanol will be provided as a commercial grade methanol as generally classified according to ASTM purity grades A and AA. Both grade A and grade AA purity methanol are ninety nine point eighty five percent (99.85%) methanol by weight. However, grade "AA" methanol may contain small trace amounts of ethanol, as noted in ASTM Standard Specification D1152-06 (2012).

Preferably, a high grade ethanol which has been dehydrated, such as by a molecular sieve and which may have a purity of about ninety nine percent (99%) ethanol before denaturant addition, may be utilized according to the formulations set out herein. Denatured fuel ethanol (DFE) means anhydrous ethanol that contains a denaturant to make it unfit for human consumption, and which is produced for use in gasoline. Denaturant concentration in DFE must not exceed three point zero percent (3.0%) by volume percent, per the US Code of Federal Regulations, at 40 CFR § 1090.270. Commercial ethanol generally is obtained with about two percent (2%) by volume of denaturant.

Alternately in the various fuel blends discussed herein, the ethanol composition provided for blending may be provided as fuel grade ethanol. Suitable fuel grade ethanol supplies are those described by ASTM Standard Specification D4086-21a, entitled Standard Specification for Denatured Fuel Ethanol for Blending with Gasolines for Use as Automotive Spark-Ignition Engine Fuel, dated Oct. 1, 2021. That specification covers "nominally anhydrous" ethanol, which is specified to be ninety two point one percent (92.1%) ethanol, as a minimum, as tested by ASTM Standard Specification D5501, and thus any ethanol supplies containing water in quantities slightly in excess of those specified by the just mentioned ASTM specification should be adjusted to provide the recommended ethanol percentages in a final fuel blend, as will be understood by those of skill in the art. Additionally, the referenced ASTM specification sets out the permitted denaturants (which may vary in the State of California), which may be expected to be present in small quantities which do not otherwise affect the general fuel blend formula descriptions set out herein.

Similarly, commercial grade toluene should be utilized. As an example, commercial grade toluene as manufactured by Chevron® Phillips Chemical Company, Specialty Chemicals, 10001 Six Pines Drive, Woodland, Texas 77380, appears to be sold under the brand TrusTec® brand toluene, with a purity of ninety nine point five percent (99.5%) toluene.

Another advantage of the novel unleaded racing fuel composition as provided herein is that may be easily and readily tested for conformance with a specified composition. For example, one or more standardized and interoperably interpretable test methods may be provided (e.g. a method for determination of composition of an alcohol based fuel using a GC-FID (gas chromatograph, flame ionization detector) system may be provided. By utilizing fuel standard specifications, test protocols, and test equipment data output protocols, the time and cost of handling fuel blend testing can be minimized.

A method for operating spark ignited internal combustion piston engines in racing competition is also facilitated by use of the fuel blends disclosed herein. Such a method may include providing an unleaded racing fuel blend consisting essentially of: methanol at thirty five percent (35%), plus or minus five percent (5%) by volume, ethanol at thirty five percent (35%), plus or minus five percent (5%) by volume, toluene at from twenty five percent (25%) to fifteen percent (15%) by volume, isopentane or cyclopentane, or mixtures thereof, at from fifteen percent (15%) to five percent (5%) by volume, and optionally, one or more additives selected from the group consisting of anti-oxidants, anti-icing agents, anti-static additives, corrosion inhibitors, dyes, denaturants, co-solvents, lubricants, and mixtures thereof.

During use of the alcohol based unleaded automotive racing fuel blends described herein, since water and ethanol are miscible, the ethanol component discourages phase separation of the isopentane and of the methanol, should the fuel mixture absorb substantial water from the atmosphere. However, particularly depending upon the temperature of storage or of use, in an embodiment it may be useful to include a small amount of a selected co-solvent to further discourage phase separation of components of the fuel blend. In an embodiment, ethyl acetate may be used as a co-solvent. In an embodiment, ethyl acetate may be provided at two percent (2% or less) by volume. In an embodiment, ethyl acetate may be provided in an amount between one percent (1%) and two percent (2%), inclusive, by volume. In an embodiment, ethyl acetate may be provided in an amount of about one percent (1%) or less, by volume.

In an embodiment, the unleaded automotive racing fuel blend may be characterized in that the racing fuel blend is selected and optimized for use in an automotive engine configured for supply of air and fuel to the automotive engine at an air-fuel ratio in a range of from about eight to one to about ten to one (about 8:1 to about 10:1). Such fuel blends are advantageously combusted in an internal combustion spark ignition engine, to provide motive force for a race car. In an embodiment, the racing fuel blend may be selected and optimized for use in an automotive engine configured for supply of air and fuel to the automotive engine at an air-fuel ratio in a range of from nine to one to about ten to one (about 9:1 to about 10:1). In an embodiment, the racing fuel blend may be selected and optimized for use in an automotive engine configured for supply of air and fuel to the automotive engine at an air-fuel ratio in a range of from nine point five to one, to about ten to one (about 9.5:1 to about 10:1). In an embodiment, the racing fuel blend may be selected and optimized for use in an automotive engine configured for supply of air and fuel to the automotive engine at an air-fuel ratio in a range of from about nine point seven to one, to about nine point nine to one (about 9.8:1 to about 9.9:1).

In the foregoing description, for purposes of explanation, numerous details have been set forth in order to provide a thorough understanding of the disclosed exemplary embodiments for the formulation of a novel unleaded automotive racing fuel blend. For descriptive purposes, various relative terms have been used. Terms that are relative only to a point of reference are not meant to be interpreted as absolute limitations, but are instead included in the foregoing description to facilitate understanding of the various aspects of the disclosed embodiments.

Additionally, various ranges and endpoints for fuel blends have been set out in this specification and accompanying claims. However, those of skill in the art will recognize that reliability, precision and accuracy of test methods may vary amongst test methods used for testing of various constituents. Consequently, test data results within the standard deviation for any such test method yet not within the stated limit shall nevertheless be considered to fall within the scope of the claimed constituent. The variability of a test method under controlled conditions provides a measure of precision of any test method, and the actual value represented by any test result shall be understood not to be absolute, but should be considered within an appropriate range of values as will be understood by those of skill in the art of analytical test methods and physical test methods as applicable. In this regard, the term "about" as used with respect to fuel blend formulations shall mean within one percent (1%) by volume of the stated constituent amount.

Further, various actions or activities in a method described herein may have been described as multiple discrete activities, in turn, in a manner that is most helpful in understanding the fuel blends described herein. However, the order of description should not be construed as to imply that such activities are necessarily order dependent. In particular, certain mixing or blending operations may not necessarily need to be performed in the order of presentation. And, in different embodiments, one or more activities may be performed simultaneously, rather than sequentially. Also, the reader will note that the phrase "in an embodiment" or "in one embodiment" has been used repeatedly. This phrase generally does not refer to the same embodiment; however, it may. Finally, the terms "comprising", "having" and "including" should be considered synonymous, unless the context dictates otherwise.

Further, it should be understood by those of skill in the art and to whom this specification is directed that the term "automotive" has been used herein consistent with various regulations in the United States to mean a device that is used or intended to be used for transportation over the ground. Accordingly, the term is not limited to four (4) wheeled vehicles or "race cars" alone. Accordingly, the term "automotive" as used herein also includes two (2) wheeled vehicles (e.g. motorcycles) or three (3) wheeled vehicles which as otherwise set out herein are powered by spark ignition piston driven internal combustion engines. Thus, the alcohol based unleaded automotive racing fuel blends described and claimed herein should be considered as useful for any such "automotive" vehicle, as fuels described herein are particularly useful for various types of vehicles using such engines for motive power in various racing formats and venues.

Although only a few exemplary embodiments have been described in detail, various details are sufficiently set forth, and the advantages of the novel alcohol based unleaded automotive racing fuel blend will be understood by those of skill in the art from information provided in the drawing figures, and otherwise in the specification provided herein, to enable one of ordinary skill in the art to make and use the invention(s), which need not be further described by additional writing in this detailed description. It will be readily apparent to those skilled in the art that the alcohol based unleaded automotive racing fuel blend may be modified from embodiments provided herein, without materially departing from the novel teachings and advantages provided.

Thus, it is to be understood that the various aspects and embodiments described and claimed herein may be modified from those shown without materially departing from the novel teachings and advantages provided by this invention, and may be embodied in other specific forms without departing from the spirit or essential characteristics thereof. Therefore, the embodiments presented herein are to be considered in all respects as illustrative and not restrictive. As such, this disclosure is intended to cover the compositions described herein and equivalent compositions. Numerous modifications and variations are possible in light of the above teachings. It is therefore to be understood that within the scope of the appended claims, the invention(s) may be practiced otherwise than as specifically described herein.

The scope of the invention(s), as set forth in the appended claims, and as indicated by the drawing figures and by the foregoing description, is intended to include variations from the embodiments provided which are nevertheless described by the broad interpretation and range properly afforded to the plain meaning of the claims set forth below.

The invention claimed is:

1. An unleaded automotive racing fuel blend, comprising:
(a) methanol at from thirty percent (30%) to forty percent (40%) by volume;
(b) ethanol at from forty percent (40%) to thirty percent (30%) by volume;
(c) toluene at from thirty five percent (35%) to fifteen percent (15%) by volume;
(d) isopentane or cyclopentane, or mixtures thereof, at from three percent (3%) to ten percent (10%) by volume; and
(e) optionally, one or more additives selected from the group consisting of anti-oxidants, anti-static additives, corrosion inhibitors, denaturants, co-solvents, lubricants, and mixtures thereof.

2. An unleaded automotive racing fuel blend, consisting essentially of:
(a) methanol at from thirty percent (30%) to forty percent (40%) by volume;
(b) ethanol at from forty percent (40%) to thirty percent (30%) by volume;
(c) toluene at from thirty five percent (35%) to fifteen percent (15%) by volume;
(d) isopentane or cyclopentane, or mixtures thereof, at from three percent (3%) to ten percent (10%) by volume; and
(e) optionally, one or more additives selected from the group consisting of anti-oxidants, anti-static additives, corrosion inhibitors, denaturants, co-solvents, lubricants, and mixtures thereof.

3. An unleaded automotive racing fuel blend, consisting of:
(a) methanol at from thirty percent (30%) to forty percent (40%) by volume;
(b) ethanol at from forty percent (40%) to thirty percent (30%) by volume;
(c) toluene at from thirty five percent (35%) to fifteen percent (15%) by volume;
(d) isopentane or cyclopentane, or mixtures thereof, at from three percent (3%) to ten percent (10%) by volume; and
(e) optionally, one or more additives selected from the group consisting of anti-oxidants, anti-static additives, corrosion inhibitors, denaturants, co-solvents, lubricants, and mixtures thereof.

4. An unleaded automotive racing fuel blend as set forth in claim 1, or in claim 2, or in claim 3, wherein said isopentane or cyclopentane, or mixtures thereof, are present at from ten percent (10%) to five percent (5%) by volume.

5. An unleaded automotive racing fuel blend, comprising:
(a) methanol at about thirty five percent (35%) by volume;
(b) ethanol at about thirty five percent (35%) by volume;
(c) toluene at about twenty two percent (22%) by volume;
(d) isopentane or cyclopentane, or mixtures thereof, at about eight percent (8%) by volume; and
(e) optionally, one or more additives selected from the group consisting of anti-oxidants, anti-static additives, corrosion inhibitors, denaturants, co-solvents, lubricants, and mixtures thereof.

6. An unleaded automotive racing fuel blend, consisting essentially of:
(a) methanol at about thirty five percent (35%) by volume;
(b) ethanol at about thirty five percent (35%) by volume;
(c) toluene at about twenty two percent (22%) by volume;
(d) isopentane or cyclopentane, or mixtures thereof, at about eight percent (8%) by volume; and
(e) optionally, one or more additives selected from the group consisting of anti-oxidants, anti-static additives, corrosion inhibitors, denaturants, co-solvents, lubricants, and mixtures thereof.

7. An unleaded automotive racing fuel blend, consisting of:
(a) methanol at about thirty five percent (35%) by volume;
(b) ethanol at about thirty five percent (35%) by volume;
(c) toluene at about twenty two percent (22%) by volume;
(d) isopentane or cyclopentane, or mixtures thereof, at about eight percent (8%) by volume; and
(e) optionally, one or more additives selected from the group consisting of anti-oxidants, anti-static additives, corrosion inhibitors, denaturants, co-solvents, lubricants, and mixtures thereof.

8. An unleaded automotive racing fuel blend, comprising:
(a) methanol at thirty five percent (35%), plus or minus five percent (5%) by volume;
(b) ethanol at thirty five percent (35%), plus or minus five percent (5%) by volume;
(c) toluene at from thirty five percent (35%), plus or minus five percent (5%) by volume;
(d) isopentane or cyclopentane, or mixtures thereof, at five percent (5%) to ten percent (10%) by volume; and
(e) optionally, one or more additives selected from the group consisting of anti-oxidants, anti-static additives, corrosion inhibitors, denaturants, co-solvents, lubricants, and mixtures thereof.

9. An unleaded automotive racing fuel blend, consisting essentially of:
(a) methanol at thirty five percent (35%), plus or minus five percent (5%) by volume;
(b) ethanol at thirty five percent (35%), plus or minus five percent (5%) by volume;
(c) toluene at from thirty five percent (35%), plus or minus five percent (5%) by volume;
(d) isopentane or cyclopentane, or mixtures thereof, at five percent (5%) to ten percent (10%) by volume; and
(e) optionally, one or more additives selected from the group consisting of anti-oxidants, anti-static additives, corrosion inhibitors, denaturants, co-solvents, lubricants, and mixtures thereof.

10. An unleaded automotive racing fuel blend, consisting of:
(a) methanol at thirty five percent (35%), plus or minus five percent (5%) by volume;
(b) ethanol at thirty five percent (35%), plus or minus five percent (5%) by volume;
(c) toluene at from thirty five percent (35%), plus or minus five percent (5%) by volume;
(d) isopentane or cyclopentane, or mixtures thereof, at five percent (5%) to ten percent (10%) by volume; and
(e) optionally, one or more additives selected from the group consisting of anti-oxidants, anti-static additives, corrosion inhibitors, denaturants, co-solvents, lubricants, and mixtures thereof.

11. An unleaded automotive racing fuel blend as set forth in claim 1, or claim 5, or claim 9, with a proviso that the fuel blend contains less than one percent (1%) hydrocarbon constituents other than those set out therein.

12. An unleaded automotive racing fuel blend as set forth in claim 1, or claim 5, or claim 9, wherein said co-solvent is provided.

13. An unleaded automotive racing fuel blend as set forth in claim 12, wherein the co-solvent comprises ethyl acetate.

14. The unleaded automotive racing fuel blend of claim 1, or of claim 5, or of claim 8, wherein the unleaded racing fuel blend has a Total Heat Value of at least eighty eight (88), and is configured for stable combustion in spark-ignition engines operating at compression ratios of at least ten to one (10:1).

15. The unleaded automotive racing fuel blend of claim 1, or of claim 5, or of claim 8, wherein the unleaded racing fuel blend is optimized for combustion in an engine at an air-fuel ratio in the range from about eight to one (8:1) to about ten to one (10:1).

* * * * *